US005376186A

United States Patent [19]

Uchida et al.

[11] Patent Number: 5,376,186

[45] Date of Patent: Dec. 27, 1994

[54] HEAT TREATING OIL COMPOSITION

[75] Inventors: Hitoshi Uchida; Saburo Koyama, both of Ichihara; Eiichi Nakamura, Tokyo, all of Japan

[73] Assignee: Idemitsu Kosan Co., Ltd., Tokyo, Japan

[21] Appl. No.: 118,204

[22] Filed: Sep. 9, 1993

Related U.S. Application Data

[63] Continuation-in-part of Ser. No. 961,649, Oct. 16, 1992, Pat. No. 5,250,122.

[30] Foreign Application Priority Data

Oct. 18, 1991 [JP] Japan ..... 3-271073

[51] Int. Cl.[5] ..... B23K 35/34

[52] U.S. Cl. ..... 148/29

[58] Field of Search ..... 148/29

[56] References Cited

U.S. PATENT DOCUMENTS 3,159,510 12/1964 Rozalsky ..... 148/28

3,281,288 10/1966 Carver ..... 148/28

*Primary Examiner*—Peter D. Rosenberg

*Attorney, Agent, or Firm*—Antonelli, Terry, Stout & Kraus

[57] ABSTRACT

Disclosed is a heat treating oil composition which comprises a base oil adjusted to have a total sulfur content of 3 to 1000 ppm comprising (A) at least one base oil selected from a mineral oil and a synthetic oil each having a sulfur content of not more than 300 ppm and (C) at least one member selected from a sulfur and a sulfur compound, and (B) at least one additive selected from an alkaline earth metal salt of sulfonic acid, that of a phenol, alkenyl succinic acid derivatives, fatty acid or its derivatives and phenol-based and amine-based antioxidants.

The above-mentioned heat treating oil composition is suitable for quenching under a condition of a high oil temperature, and realizes a treated metal product having a excellent brightness and little distortion.

5 Claims, No Drawings

HEAT TREATING OIL COMPOSITION

CROSS-REFERENCE TO RELATED APPLICATION

This is a continuation-in-part of application, Ser. No. 961,649, filed Oct. 16, 1992 now U.S. Pat. No. 5250,122.

BACKGROUND OF THE INVENTION

1. Field of the Invention

The present invention relates to a heat treating oil composition, particularly a quenching oil composition. More particularly, it relates to a new type heat treating oil composition excellent in the stability at high temperature, suitable for quenching under the condition of a high oil temperature and capable of providing an object to be treated with excellent particularly in the initial phase of treatment with new oil, and long surviving brightness.

2. Description of Related Arts

Conventionally, a heat treatment, for example a quenching treatment has been given by feeding a metal heated to a high temperature into a quenching oil at 60° to 150° C. and quenching and hardening it. During the process of this quenching treatment, the metal preferably is quenched even at a higher oil temperature such as 170° to 250° C. to make the effective correction for a distortion.

However, conventionally known heat treating oils, for example those which are mixed with mineral oil, fatty acid, alkenyl succinimide and the like (Japanese Patent Applications Laid Open No. 4508/1977, No. 15913/1986, No. 106710/1986 and the like) have various problems that the stability at high temperature is poor, the life span of brightness is short, or the like. Meanwhile, inferior brightness has been blamed as one of the reasons for an increase of distortion associated with quenching.

On the other hand, the heat treating oil can have the improved stability at high temperatures by comprising a highly purified base oil. It has been known, however, that resulting in an increase of inferior brightness, quenching unevenness and quenching distortion.

Moreover, a marquenching treatment (at a liquid temperature closely above the Ms point of the object to be treated, that is, usually 160° to 250° C.) using salt has also been known as suitable for decreasing the quenching distortion. But this treatment has been found to have poorer working efficiency than that of quenching oil, accompanied even by environmental problems.

Thus, the present inventors have made intensive studies with a view to finding a solution in these problems and developing a heat treating oil composition capable of quenching at high oil temperatures and obtaining a treated metal having excellent brightness and free of the distortion.

As the result, it has been found that said objects can be achieved by a heat treating oil composition comprising a base oil consisting of a highly purified mineral oil or synthetic oil and a specific content of sulfur, along with various additives for quenching. The present invention has been completed on the basis of this finding.

SUMMARY OF THE INVENTION

The present invention provides a heat treating oil composition which comprises (I) a base oil having a sulfur content of 3 to 1000 ppm consisting of (A) at least one member selected from a mineral oil and a synthetic oil each having a sulfur content of not more 300 ppm and (C) at least one member selected from a sulfur and a sulfur compound and (II) additives for quenching (B) comprising at least one member selected from an alkaline earth metal salt of sulfonic acid, an alkaline earth metal salt of phenol, a derivative of alkenyl succinic acid, a fatty acid or its derivative and a phenol-based or an amine-based antioxidant.

Furthermore, the present invention also provides a method for quenching which comprises quenching with above-mentioned heat treating oil compositions at a high oil temperature.

DESCRIPTION OF THE PREFERRED EMBODIMENTS

The (A) component of the present invention includes at least one member selected from a mineral oil and a synthetic oil each having a sulfur content of not more than 300 ppm. When the sulfur content of the mineral oil is more than 300 ppm, inferior brightness or the quenching distortion is liable to occur in the object to be treated. On the other hand, when the mineral oil is even more highly purified to have the sulfur content of preferably not more than 100 ppm, more preferably not more than 30 ppm, the object treated and quenched by using the composition of the present invention is provided with brightness having a longer span of life. These conditions of the sulfur content hold good for the synthetic oil as well.

The kind of mineral oil and synthetic oil to be used as the (A) component is not particularly limited. Examples of the mineral oil to be used herein are the highly purified product of a paraffinic mineral oil, an intermediate mineral oil and a naphthenic mineral oil, each having the sulfur content satisfying said conditions. Examples of the synthetic oil to be used herein include various oils, for example an olefin (co) polymer having from 2 to 16 carbon atoms (including an oligomer), alkylbenzene, alkylnaphthalene, a polyphenyl hydrocarbon, various esters including fatty acid esters of neopentylglycol, trimethylolpropane, pentaerythritol and the like. An olefin oligomer or its hydrogenated product having from 8 to 12 carbon atoms is most suitable among them.

Of these mineral oils and synthetic oils, not only one member can be used singly but also two or more as their mixture at a discretionary ratio. The so obtained (A) component ordinarily has a kinematic viscosity of 2 to 100 cSt at 100° C.

Said (A) component is mixed with sulfur and a sulfur compound as the (C) component of the present invention to obtain a base oil having a total sulfur content of 3 to 1000 ppm, preferably 5 to 800 ppm, capable of decreasing the quenching distortion, providing brightness having a longer span of life and improving brightness in the initial phase of quenching. It is even more preferable for the base oil to have a nitrogen content of not more than 30 ppm, especially 20 ppm, along with the total sulfur content of 3 to 1000 ppm. Therein, when the nitrogen content is excess in amount, color changes (in striped pattern) on the surface of the object are liable to occur during quenching, which causes increase in distortion.

Of said sulfur and the sulfur compounds as the (C) component, not only one member can be used singly but also two or more in their discretionary combination.

Various sulfur compounds can be used to improve brightness of the object to be treated, including compounds of sulfides, disulfides, polysulfides, mercaptans and thiophenes. More specifically, sulfides include diethylsufide, di-n-propylsulfide, di-n-butylsulfide, di-iso-butylsulfide, di-tert-butylsulfide, di-n-hexylsulfide, diphenylsulfide, dibenzylsulfide and the like. Disulfides include diethyldisulfide, di-n-propyldisulfide, di-n-butyldisulfide, di-iso-butyldisulfide, di-sec-butyldisulfide, di-tert-butyldisulfide, di-n-heptyldisulfide, di-tert-heptyldisulfide, di-tert-lauryldisulfide, diphenyldisulfide, dibenzyldisulfide and the like. Polysulfides include dibenzylpolysulfide. Mercaptans include tert-dodecylmercaptan, n-tetradecylmercaptan, n-cetylmercaptan, thiophenol, p-thiocresol and the like. Further, thiophenes include thiophene, benzothiophene, dibenzothiophene, alkyl substitutes their of and the like. Besides, there can be mentioned sulfurized alkylphenate of an alkaline earth metal, a mineral oil having a sulfur content of not more than 2.0%, a sulfurized mineral oil, olefin sulfide, a sulfurized fat, thiadiazoles and the like. It is preferable that this mineral oil having the sulfur content of not more than 2.0% has particularly a nitrogen content of not more than 400 ppm as well.

However, among the sulfur compounds, for example sulfoxide or sulfonic acid or its salts practically cannot improve brightness or reduce the quenching distortion in the object to be treated.

At least one member selected from the above-mentioned alkaline earth metal salts of sulfonic acid and phenol, a derivative of alkenylsuccinic acid, a fatty acid or its derivative, and a phenol-based or an amine-based antioxidant as (B) component of the present invention should be incorporated into the base oil consisting of the (A) component and the (C) component in combination.

Following are the description of (B) component in the present invention.

The various alkaline earth metal salts of sulfonic acid and phenol can be used in the present invention.

Most suitable among the alkaline earth metal salts of sulfonic acid is, for example a sulfonate compound represented by the following general formula (1):

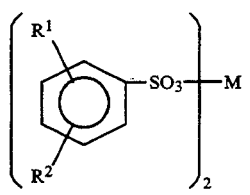

(1)

wherein $R^1$ and $R^2$ each are a hydrogen atom or an alkyl group having from 12 to 24 carbon atoms, provided that $R^1$ and $R^2$ are not the hydrogen atom at the same time; and M is Ca, Ba or Mg.

Most suitable among the alkaline earth metal salts of phenol is a phenate compound of the general formula (2):

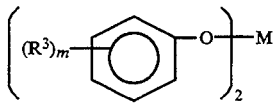

(2)

wherein $R^3$ is an alkyl group having from 9 to 24 carbon atoms, m is an integer of from 1 to 4 and M is same as defined above.

Of these alkaline earth metal salts of sulfonic acid and phenol, not only one member alone can be used singly but also two or more in their discretionary combination.

The alkenyl group of alkenyl succinic acid derivative includes dodecenyl group, octadodecenyl group, polybutenyl group, polyisobutenyl group, and polypropylenyl group, and examples of said derivatives are esters with trimethylolpropane, neopentyl glycol, and pentaerythritol, imides with triethylene-tetramine, tetraethylenepentamine, and pentaethylenehexamine, and borates of these imides.

Examples of fatty acids or derivatives thereof are straight chain and/or branched, saturated and/or unsaturated fatty acids (such as isostearic acid) having 12 to 22 carbon atoms, and esters thereof; and the alcohol components include straight chain and/or branched, saturated and/or unsaturated monohydric or polyhydric alcohols having 2 to 10 carbon atoms, such as butanol, ethylene glycol, glycol, glycerol, polyglycerol, and sorbitane; and further, fats and oils of animals and vegetables such as tallow, lard, soybean oil, and rape-seed oil are also included in said derivatives of fatty acids.

Phenol-based antioxidants include, for example, hindered phenol antioxidants (such as 2,6-di-tert-butylparacresol), amine-based antioxidants include α-naphthylamine, phenylnaphthylamine, and diphenylamine.

The above-mentioned antioxidants are effective when mixed in a proportion of usually 0.05 to 10% by weight based on the total amount of the composition.

The appropriate proportions of other (B) components are usually 0.05 to 40% by weight.

Basically, the composition of the present invention is prepared by incorporating (II) the additives (B) component into (I) the base oil consisting of the (A) component and (C) component in combination and, when desired, (D) various other additives may as well be further mixed therein.

Examples of the other additive (D) include an cooling capacity improver (for example, polybutene, polymethacrylate and the like).

A metal material such as steel material is subjected to a quenching treatment using a composition of the present invention by presetting a temperature of the composition as the heat treating oil preferably at an ordinary quenching temperature (around 60° to 150° C.) and more preferably at a higher temperature of 170° to 250° C. When the metal material such as steel material is treated and quenched by using the composition of the present invention under the condition of such a high oil temperature, cooling unevenness is hard to occur, the object to be treated is provided with excellent and long surviving brightness and further the distortion of the object to be treated is decreased. Furthermore, the composition of the present invention has a feature in providing, as a metal quenching oil, a brightness also in the initial phase of the treatment (that is, as a new oil). Usually, an improvement in brightness is difficult to be obtained with a new oil. Further, has the excellent stability at high temperatures and thus can be used for a long period of time.

Furthermore, the heat treating oil composition of the present invention is as effective in the tempering treatment as in the quenching treatment.

As stated above, the heat treating oil composition of the present invention is excellent in the quenching treatment at high oil temperatures as compared with conventional methods and further the performance of the composition can be improved to a great extent by combining various components of the present invention.

Therefore, the heat treating oil composition of the present invention will find very high usefulness in the quenching treatment at high oil temperatures.

Particularly, it will be very highly useful in the field of quenching precision parts such as carburized gear and bearing wherein a CAFE (Cooperated Average Fuel Economy) measure and an anti-noise measure are critical.

Next, the present invention will be described in greater detail with reference to examples and comparative examples.

EXAMPLES 1~14, COMPARATIVE EXAMPLES 1~3

(1) Table 1-1~Table 1-4 show the mixing ratio of the components in all examples and comparative examples.

TABLE 1-1

| | Mixing Ratio (% by weight) | Examples 1 | 2 | 3 | 4 |
|---|---|---|---|---|---|
| A | Mineral oil 4S (S content 3 ppm >) | 87.5 | 92.5 | 89.5 | 89.5 |
| | Synthetic oil | | | | |
| B | Ca sulfonate (TBN300) | | | | |
| | Ca phenate (TBN200) | 5 | 5 | 5 | |
| | Polybutenylsuccinimide | | | | 5 |
| | Ba sulfonate (TBN200) | | | | |
| | Isostearic acid | | | | |
| | Fats and oils (soybean oil) | | | | |
| | α-naphthylamine | | | | |
| | Ca salicylate (TBN300) | | | | |
| C | Sulfurized Ca phenate | | | | |
| | Benzothiophene (S content 17.4 wt %) | | | | |
| | Mineral Oil 1S (S = 0.5 wt %) | | | | |
| | Total sulfur content (ppm) | | | | |

TABLE 1-1-continued

| | Mixing Ratio (% by weight) | Examples 1 | 2 | 3 | 4 |
|---|---|---|---|---|---|
| | (soybean oil) | | | | |
| | α-naphthylamine | 0.5 | 0.5 | 0.5 | 0.5 |
| | Ca salicylate (TBN300) | | | | |
| C | Sulfurized Ca phenate | 2.0 | 2.0 | | |
| | Benzothiophene (S content 17.4 wt %) | | | | |
| | Mineral Oil 1S (S = 0.5 wt %) | 5.0 | | 5.0 | 5.0 |
| | Total sulfur content (ppm) | 750 | 500 | 250 | 250 |

TABLE 1-2

| | Mixing Ratio (% by weight) | Examples 5 | 6 | 7 | 8 |
|---|---|---|---|---|---|
| A | Mineral oil 4S content (S content 3 ppm >) | 99.45 | 97.0 | 94.95 | 94.95 |
| | Synthetic oil | | | | |
| B | Ca sulfonate (TBN300) | | | | 5 |
| | Ca phenate (TBN200) | | | 5 | |
| | Polybutenylsuccinimide | | | | |
| | Ba sulfonate (TBN200) | | | | |
| | Isostearic acid | | | | |
| | Fats and oils (soybean oil) | | | | |
| | α-naphthylamine | 0.5 | 0.5 | | |
| | Ca salicylate(TBN300) | | | | |
| C | Sulfurized Ca phenate | | 2.5 | | |
| | Benzothiophene (S content 17.4 wt %) | 0.05 | | 0.05 | 0.05 |
| | Mineral Oil 1S (S = 0.5 wt %) | | | | |
| | Total sulfur content(ppm) | 100 | 750 | 100 | 100 |

TABLE 1-3

| | Mixing Ratio (% by weight) | Examples 9 | 10 | 11 | 12 | 13 | 14 |
|---|---|---|---|---|---|---|---|
| A | Mineral oil 4S content (S content 3 ppm >) | 93.5 | 93.5 | 93.5 | 88.5 | 91.5 | |
| | Synthetic oil | | | | | | 92.5 |
| B | Ca sulfonate (TBN300) | | | | | | |
| | Ca phenate (TBN200) | | | | 5 | 5.0 | 5.0 |
| | Polybutenylsuccinimide | | | | | | |
| | Ba sulfonate (TBN200) | 1.0 | | | 1.0 | 1.0 | 1.0 |
| | Isostearic acid | | 1.0 | | | | |
| | Fats and oils (soybean oil) | | | 1.0 | | | |
| | α-naphthylamine | 0.5 | 0.5 | 0.5 | 0.5 | 0.5 | 0.5 |
| | Ca salicylate(TBN300) | | | | | | |
| C | Sulfurized Ca phenate | | | | | 2.0 | 2.0 |
| | Benzothiophene (S content 17.4 wt %) | | | | | | |
| | Mineral Oil 1S (S = 0.5 wt %) | 5.0 | 5.0 | 5.0 | 5.0 | | |
| | Total sulfur content (ppm) | 250 | 250 | 250 | 250 | 500 | 500 |

TABLE 1-4

| | Mixing Ratio (% by weight) | Comparative Examples 1 | 2 | 3 | 4 |
|---|---|---|---|---|---|
| A | Mineral oil 4S content (S content 3 ppm >) | | | 69.5 | |
| | Synthetic oil | | | | |
| B | Ca sulfonate (TBN300) | 5 | | | |
| | Ca phenate (TBN200) | | | 5 | |
| | Polybutenylsuccinimide | | | | 5 |
| | Ba sulfonate(TBN200) | | | | |
| | Isostearic acid | | | | |
| | Fats and oils (soybean oil) | | | | |
| | α-naphthylamine | 0.5 | 0.5 | 0.5 | 0.5 |
| C | Sulfurized Ca phenate | | 5 | | |
| | Benzothiophene (S content 17.4 wt %) | | | | |

TABLE 1-4-continued

| Mixing Ratio (% by weight) | Comparative Examples 1 | 2 | 3 | 4 |
|---|---|---|---|---|
| Mineral Oil 1S | 94.5 | 94.5 | 25 | 94.5 |
| Total sulfur content (ppm) | 4730 | 6230 | 1250 | 4700 |

(2) The performance of the heat treating oil was evaluated by measurement with the changes of brightness after the test piece was treated and quenched with a new oil and an oil deteriorated by force.

The test piece was a steel material S45C (a diameter of 10 mm×a length of 40 mm; a hardness of $H_{RC}16$). The test piece was fed into various quenching oils prepared according to the compositions shown in Table 1-1~1-4, treated and quenched. Quenching was carried out under the condition of an oil temperature of 200° C. and 10 minutes. The used mineral oil was a paraffinic mineral oil having a kinematic viscosity of 10 cST at 100 ° C.

(i) Meanwhile, force deterioration was conducted according to the Indiana Oxidation Test Method (IOT).

| Manufacturing Conditions of Deteriorated Oil | |
|---|---|
| Oil temperature | 170° C. |
| Air | 10 liter/minute |
| Catalyst | Fe & Cu |

(ii) Determination of brightness performance (surface outlook)

⊙: very good . . . No discolored parts in metallic lustre all over the surface.

○: good . . . Metallic lustre slightly reduced, with grayish parts.

x : fairly good . . . Partly turned black or brown.

Δ: no good . . . Black and brown all over, with no metallic lustre.

(iii) The results of evaluating the performance are shown in Table 2-1 and 2-2.

(3) The Quenching Treatment Performance was evaluated by Elliptical Distortion and Taper Distortion by Quenching Distortion Test and Measurement.

(i) Conditions of Quenching Distortion Test are as follows. Condition for Quenching Distortion Test (a) Quenching of bearing race

| | |
|---|---|
| [bearing race] | |
| Dimension: | |
| outer diameter | 80 mm |
| inner diameter | 70 mm |
| thickness | 5 mm |
| length | 30 mm |
| Hardness HRC | 15 |
| Material: SUJ-2 | |
| [heating condition] | |
| 850° C. × 30 min. | |
| [oil temperature] | |
| 200° C. | |

(b) Elliptical Distortion

After quenching, the max. outer diameter (a) and the min. outer diameter (b) on whole the circumference at a prescribed positions in the lengthwise direction of the bearing race are measured, and the value of the difference (a−b) is shown as Elliptical Distortion (μm).

(c) Taper Distortion

After quenching, each end of the bearing race is measured for the outer diameter, each average value (c), (d) of the outer diameter are calculated out, and the absolute value of the difference between (c) and (d), that is |(c)−(d)| is shown as Taper Distortion (μm).

(Evaluation)

As the distortions, that is, the above-mentioned differences are larger, more griding steps are required. Accordingly, said values are preferably smaller.

For example, it is said that if the value is reduced by several μm, one of the grinding step can be omitted. (ii) The results of evaluation of Quenching Treatment Performance are shown in Tables 2-1 and 2-2.

TABLE 2-1

| | Examples 1 | 2 | 3 | 4 | 5 | 6 | 7 | 8 |
|---|---|---|---|---|---|---|---|---|
| 10T | Brightness | | | | | | | |
| deteriorating time (hr) | | | | | | | | |
| 0 | ○ | ○ | ○ | ⊙ | ○ | ○ | ○ | ○ |
| 24 | ⊙ | ⊙ | ⊙ | ⊙ | ○ | ○ | ⊙ | ⊙ |
| 48 | ⊙ | ⊙ | ⊙ | ⊙ | ○ | ○ | ⊙ | ⊙ |
| 72 | ⊙ | ⊙ | ⊙ | ⊙ | ○ | ○ | ⊙ | ○ |
| 96 | ⊙ | ○ | Δ | X | Δ | Δ | ⊙ | ○ |
| 120 | X | X | X | X | X | X | X | X |
| Quenching Distortion Test | Quenching Distortion | | | | | | | |
| Elliptical Distortion (μm) | 51 | 50 | 53 | 41 | 51 | 48 | 50 | 52 |
| Taper Distortion (μm) | 8 | 7 | 7 | 5 | 8 | 7 | 8 | 7 |

TABLE 2-2

| | Examples 9 | 10 | 11 | 12 | 13 | 14 | Compara. Examples 1 | 2 | 3 | 4 |
|---|---|---|---|---|---|---|---|---|---|---|
| 10T | Brightness | | | | | | | | | |
| 1 | ⊙ | ⊙ | ⊙ | ⊙ | ⊙ | ○ | Δ | Δ | X | ○ |
| 24 | ⊙ | ⊙ | ⊙ | ⊙ | ⊙ | ⊙ | ○ | ○ | ⊙ | ○ |
| 48 | ⊙ | ⊙ | ⊙ | ⊙ | ⊙ | ⊙ | ⊙ | ⊙ | ⊙ | ○ |
| 72 | ⊙ | Δ | Δ | ⊙ | ⊙ | ⊙ | X | X | X | X |
| 96 | X | X | X | X | ⊙ | ○ | X | X | X | X |
| 120 | X | X | X | X | Δ | X | X | X | X | X |
| Quenching Distortion Test | Quenching Distortion | | | | | | | | | |
| Elliptical Distortion (μm) | 41 | 41 | 39 | 40 | 42 | 49 | 69 | 70 | 90 | 85 |
| Taper (μm) | 6 | 6 | 4 | 5 | 5 | 7 | 9 | 10 | 13 | 12 |

Tables 2-1 and 2-2 show that all the Examples of the present invention show superior results to Comparative Examples.

Specifically, when (B) component is compounded with a base oil comprising (A) component and (C) component, superior results are observed.

What is claimed is:

1. A heat treating oil composition which comprises (I) a base oil having a sulfur content of 3 to 1000 ppm consisting of (A) at least one member selected from the group consisting of a mineral oil and a synthetic oil each having a sulfur content of not more than 300 ppm and (C) at least one member selected from the group consisting of sulfur and a sulfur compound in an amount required to adjust the sulfur content of the base oil of 3 to 1000 ppm, and (II) at least one additive (B) selected from the group consisting of alkaline earth metal salt of sulfonic acid, alkaline earth metal salts of phenol, alkenyl succinic acid derivatives, fatty acid or its derivatives, phenol-based antioxidants and amine-based antioxidants.

2. A heat treating oil composition according to claim 1 comprising a mineral oil having a sulfur content of not more 100 ppm.

3. A heat treating oil composition according to claim 1 comprising a synthetic oil which consists essentially of an olefin oligomer having from 8 to 12 carbon atoms or hydrogenated product of the olefin oligomer.

4. A heat treating oil composition according to claim 1 alkaline earth metal is Ca, Ba or a mixture of them.

5. A method for quenching which comprises quenching with the heat treating oil composition according to claim 1 at a high oil temperature.

* * * * *